United States Patent [19]

Otani et al.

[11] Patent Number: 4,581,206

[45] Date of Patent: Apr. 8, 1986

[54] CATALYTIC CONVERTER

[75] Inventors: Junji Otani, Saitama; Akira Okubo, Tokyo, both of Japan

[73] Assignee: Honda Giken Kogyo Kabushiki Kaisha, Tokyo, Japan

[21] Appl. No.: 610,436

[22] Filed: May 15, 1984

[30] Foreign Application Priority Data

May 24, 1983 [JP] Japan ..... 58-91367

[51] Int. Cl.[4] ..... B01D 53/36; F01N 3/28

[52] U.S. Cl. ..... 422/171; 422/179; 422/221

[58] Field of Search ..... 422/171, 172, 177, 180, 422/221, 179; 60/299, 301

[56] References Cited

U.S. PATENT DOCUMENTS 3,902,853 9/1975 Marsee et al. ..... 422/172
4,278,639 7/1981 Tadokoro et al. ..... 422/171
4,413,392 11/1983 Otani et al. ..... 29/157

FOREIGN PATENT DOCUMENTS 2308220 9/1974 Fed. Rep. of Germany ..... 422/179

*Primary Examiner*—David L. Lacey
*Attorney, Agent, or Firm*—Lyon & Lyon

[57] ABSTRACT

A catalytic converter includes a cylindrical casing employing multiple catalytic elements. The elements are cushioned on each end and about their periphery. The elements are also held in place by end set plates and a set plate in the middle extending transversely in the cylindrical casing. The set plate in the middle is free to move and adjust within the converter to eliminate excessive stress on the catalytic elements.

4 Claims, 9 Drawing Figures

CATALYTIC CONVERTER

BACKGROUND OF THE INVENTION

The field of the present invention is catalytic converters and their construction.

Catalytic converters for use in vehicles, and more recently motorcycles in particular, have been developed which employ two catalytic elements through which exhaust gases are passed. The catalytic elements are generally formed of a porous or honeycomb structure. Such structures are generally quite fragile and subject to cracking, chipping and the like. In the rough vibrational environment of a motor vehicle, careful placement of such catalytic elements becomes necessary.

Catalytic converters employing multiple catalytic elements have been known and have included the location of the catalytic elements in series within a cylindrical housing. The catalytic elements are contained within cushion members comprising annular rings fitted around the catalytic elements and cushion rings abutting against the ends of the elements. The cushioned elements must then be retained more rigidly within the casing. Set plates are incorporated into the assembly at each end of the catalytic elements such that the cushioned catalytic elements including the cushion rings are held rigidly from moving along a coaxial centerline from the desired location.

Because of the fragile nature of the catalytic elements, it has been found necessary to insure that each of the set plates is properly positioned in an orientation truly perpendicular to the coaxial centerline of the cylindrical casing. Consequently, the set plate in the middle has been carefully positioned centrally within the cylindrical case and spot welded in place. Substantial effort and cost is required to properly locate and weld the set plate in position. The catalytic elements with their cushioning elements are inserted from either end of the casing into abuttment against the middle set plate. End set plates are then positioned outwardly of the catalytic elements in the cylindrical case.

If the set plates are not properly oriented in a perpendicular position relative to the cylindrical casing, and if those set plates are locked in place, unbalanced stresses on the catalytic element can result. Because of the fragile nature of such elements, damage to the elements can occur under such circumstances. Such damage might occur during the initial assembly when compression is applied to the assembly. Alternately, vibrational loading under such conditions may result in damage.

SUMMARY OF THE INVENTION

The present invention is directed to a catalytic converter assembly of the type generally employing multiple catalytic elements. In the present invention, a middle set plate is employed which is not anchored to the cylindrical casing. Consequently, proper orientation of the middle set plate is achieved with the assembly of the catalytic elements. Through this arrangement, the middle set plate will adjust to provide equal pressure on the adjacent cushions and in turn on the catalytic elements. Thus, biased forces in the assembly, when under compression, are avoided.

Accordingly, it is an object of the present invention to provide an improved catalytic converter construction. Other and further objects and advantages will appear hereinafter.

DETAILED DESCRIPTION OF THE PREFERRED EMBODIMENT

Figure 1:
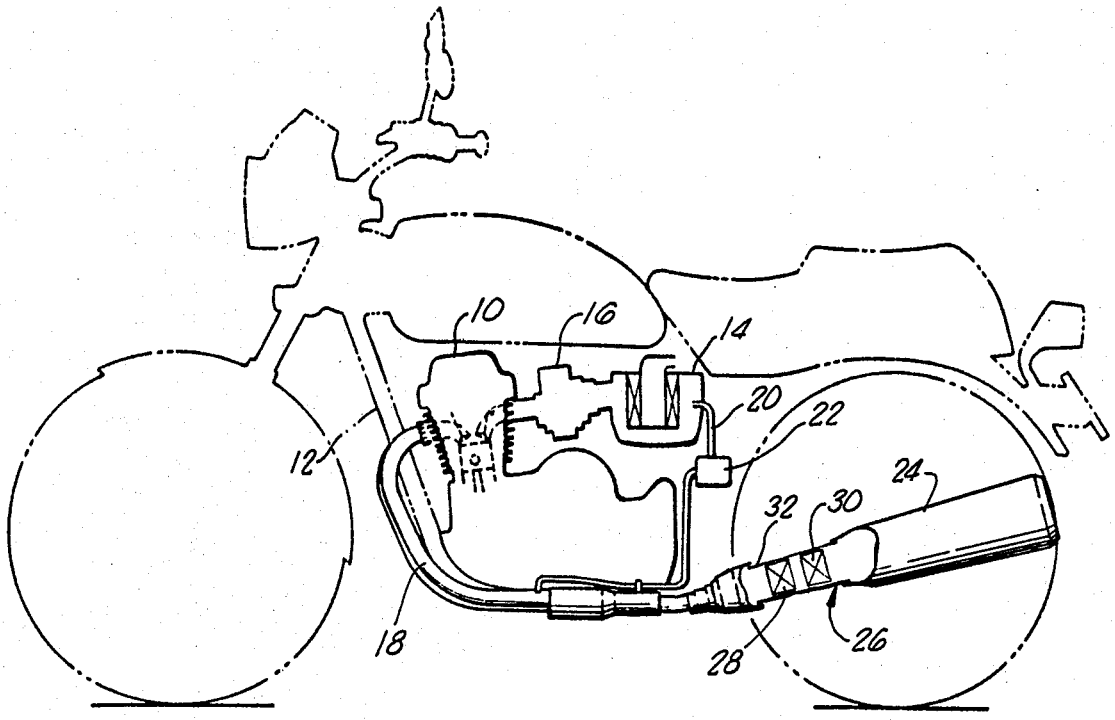
FIG. 1 is a side view of a motorcycle engine and exhaust system with a motorcycle illustrated in phantom.

Turning in detail to the drawings, FIG. 1 illustrates the environment of the present invention. A motorcycle is generally illustrated in phantom. An engine 10 is supported on the motorcycle frame 12. The engine includes an air cleaner 14, a carburetor 16 and one or more exhaust pipes 18. The exhaust system may include a secondary air supply system including a pipe 20 with a reed valve 22 controlling flow in the pipe 20.

The exhaust system extending from the exhaust pipe or pipes 18 includes a muffler 24 aft of a catalytic converter 26. The catalytic converter 26 is illustrated as including two catalytic elements 28 and 30 and a cylindrical case 32.

Figure 2:
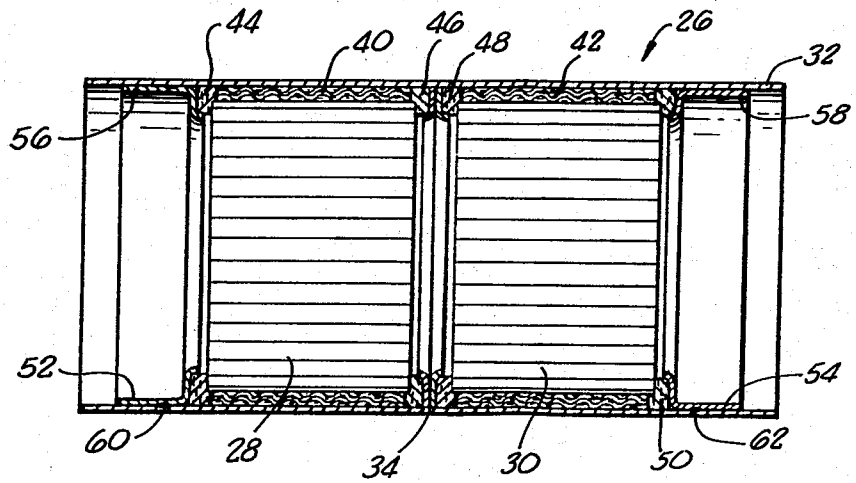
FIG. 2 is a cross-sectional side view of a catalytic converter of the present invention.
Figure 3:
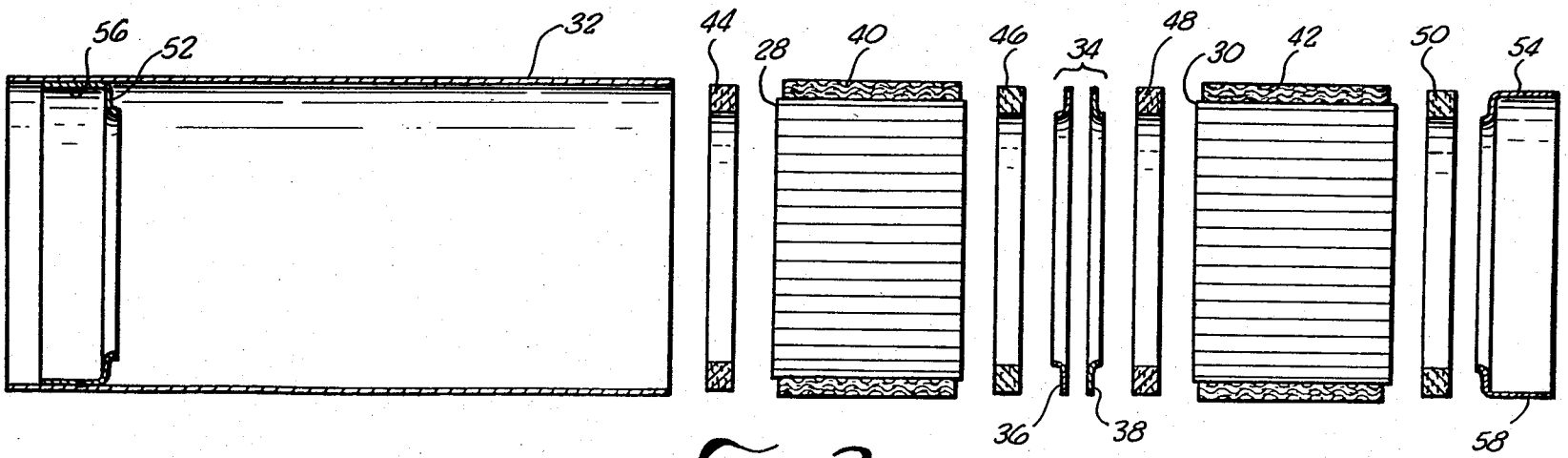
FIG. 3 is an exploded side view of the catalytic converter of FIG. 2.

Looking in greater detail to the catalytic converter 26, reference is made to FIG. 2 and FIG. 3. Two catalytic elements 28 and 30 are illustrated as receiving exhaust flow in series through a cylindrical case 32. Centrally positioned within the assembly is a middle set plate 34. The middle set plate 34 includes two ring elements 36 and 38. Each ring element includes an axially extending flange to receive and enclose an adjacent cushion member. The rings are arranged so that the flanges extend outwardly from the assembled middle set plate. This set plate 34 is positioned in the catalytic converter case 32 without being tack welded or otherwise fixed to the wall of the case.

Surrounding each of the catalytic elements 28 and 30 are cushion members 40 and 42. The cushion members 40 and 42 prevent lateral shock loads from damaging the enclosed catalytic element. Positioned on the sides of the catalytic elements 28 and 30 are cushion members 44, 46, 48 and 50. The cushion members 44, 46, 48 and 50 form rings to engage the outermost periphery of each end of the catalytic elements 28 and 30. The middle set plate 34 is located between cushion members 46 and 48.

Outwardly of the cushioned catalytic elements 28 and 30 are end set plates 52 and 54. The end set plates 52 and 54 have similar axially extending flanges to those of the middle set plate 34 so as to properly engage and encase the outer cushion members 44 and 50. The end set plates 52 and 54 include axially extending cylindrical portions 56 and 58, respectively. These extended portions 56 and 58 help maintain the plates in proper alignment with the surrounding cylindrical casing. The end set plates 52 and 54 are spot welded at points 60 and 62, respectively.

The set plate 52 is spot welded prior to assembly of the remaining components while set plate 54 is spot welded in a final assembly step.

Figure 4A:
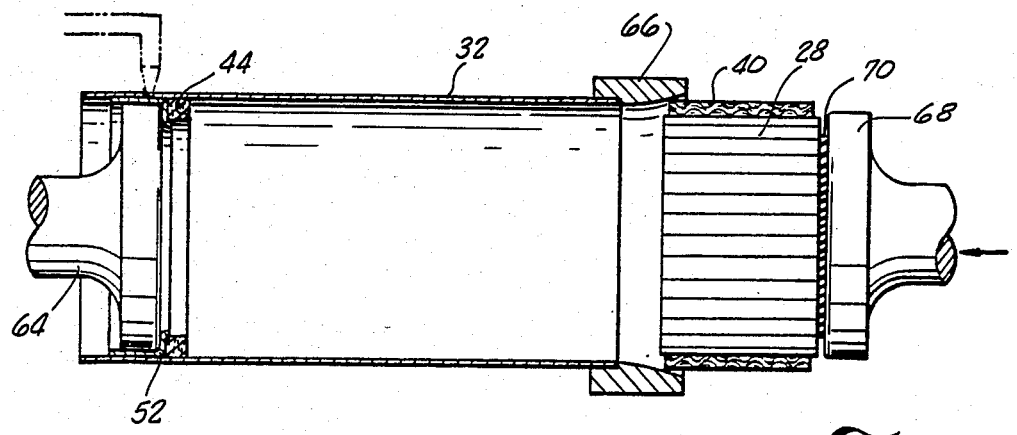
FIGS. 4A through 4D are side views illustrating the assembly of a catalytic converter of the present invention.

Looking then to the assembly of the preferred embodiment, FIGS. 4A–D illustrate progressively this assembly. The casing 32 which is conveniently of stainless steel is assembled with the first end set plate 52 on a jig 64. The set plate 52 is then spot welded to the casing 32 at appropriate locations. The cushion member 44 is positioned against the end set plate 52 in preparation for receipt of one of the two catalytic elements 28 and 30. Assembly of the catalytic element 28 is illustrated in FIG. 4A. First, the cushion member 40 is positioned about the catalytic element 28 and a guide 66 is positioned on the free end of the cylindrical casing 32. The guide 66 includes a tapered inner surface for receipt of and compression of the cushion member 40 during insertion of the catalytic element 28. A jig 68 is employed to force the catalytic element 28 into position. A sheet 70 of resilient material is positioned between the catalytic element 28 and the jig 68 to insure against damage during insertion.

Figure 4B:
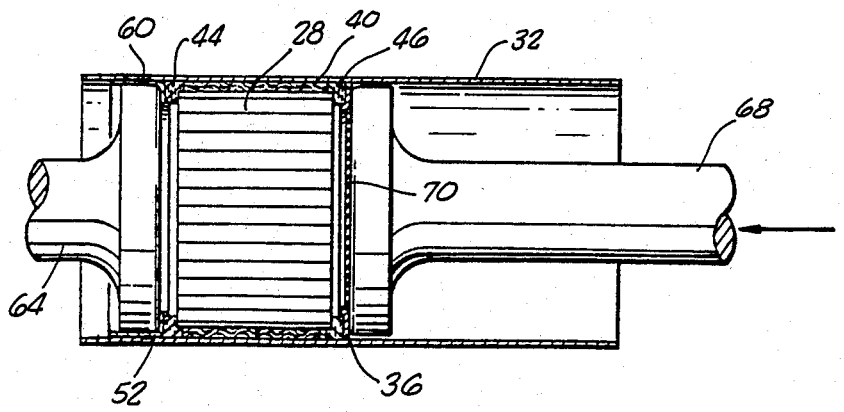

Looking next to FIG. 4B, the catalytic element 28 has been located in position, partially compressing the cushion element 44. The cushion element 46 and one element 36 of the middle set plate 34 is next positioned. The cushion 48 and the other element 38 of the middle set plate 34 is similarly positioned.

Figure 4C:
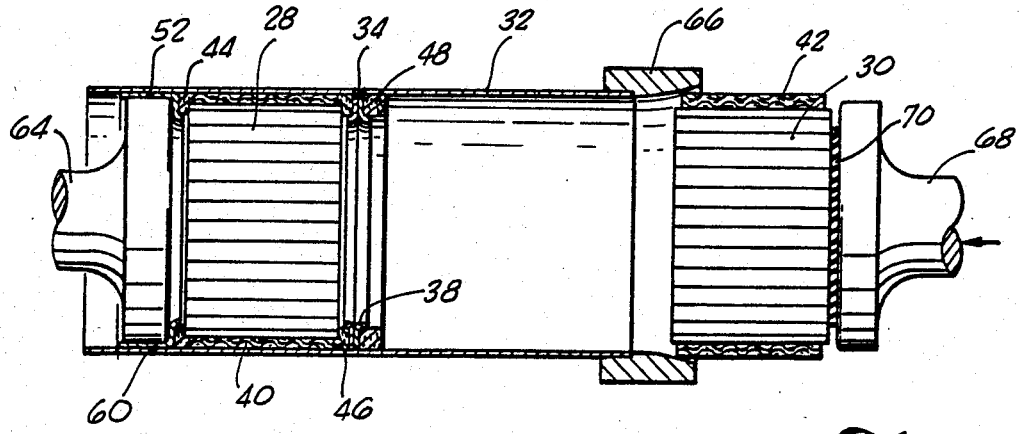
Figure 4D:
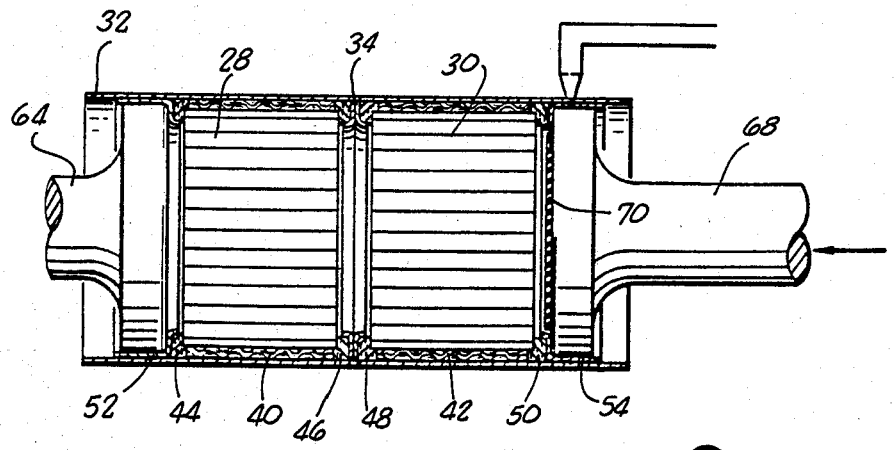

Looking at FIG. 4C, the second catalytic element 30 is in position for assembly. Once again, the guide 66 is employed to uniformly compress the cushion 42 around the catalytic element 30. As illustrated in 4D, the cushion element 50 and the second end set plate 54 are then positioned with the end plate 54 being spot welded into permanent position. Compression is placed on the cushion members either during insertion or at final assembly of the end set plate 54 to properly retain the catalytic elements 28 and 30 against damage from impact, vibration and the like. In the foregoing assembly, the middle set plate 34 was not fixed to the surrounding cylindrical casing 32. Consequently, the middle set plate 34 may adjust to accommodate the surfaces of the adjacent catalytic elements 28 and 30.

Figure 6:
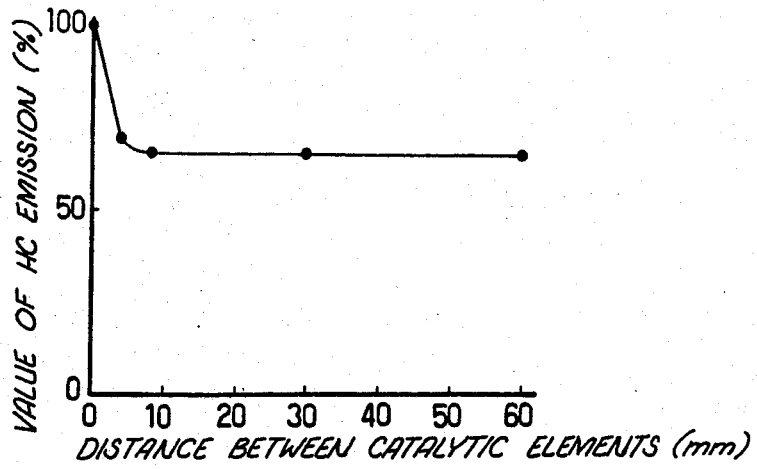
FIG. 6 is a plot illustrating the correlation between the percentage of hydrocarbon emissions versus the distance between catalytic elements.
Figure 5:
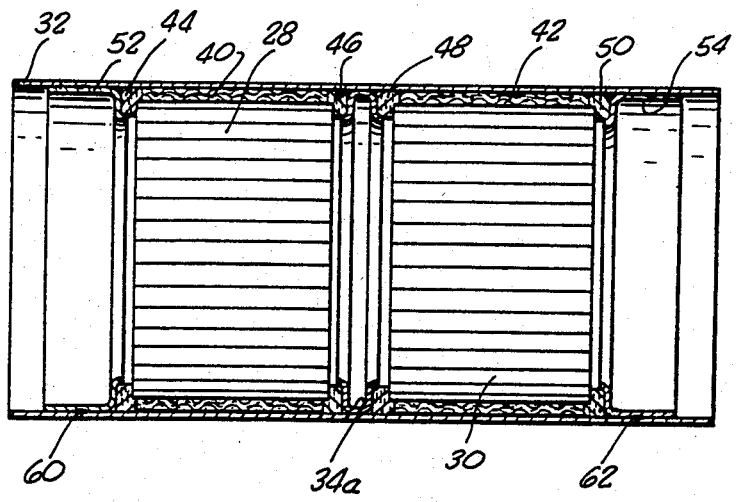
FIG. 5 is a cross-sectional side view of a second embodiment of a catalytic converter of the present invention.

Looking to an alternate embodiment, FIG. 5 illustrates a catalytic converter identical to that illustrated in FIG. 2 with the exception that the middle set plate 34A is of one piece construction and is of fixed width. This increase in the width of the middle set plate may be established at a minimum of five millimeters to provide most efficient operation of the catalytic converter. FIG. 6 illustrates the relationship between the distance between the most adjacent surfaces of each catalytic element 28 and 30 and the percentage of change in the resulting hydrocarbon level from that with the elements in contact. It can be seen that a spacing of at least five millimeters provides an advantageous increase in the amount of hydrocarbon removed from the exhaust gases. The middle set plate **34*a*** is able to control and assure that proper distance.

Thus, an improved catalytic converter structure is here disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A catalytic converter having a plurality of catalytic elements, comprising a cylindrical casing;

a rigid set plate in the middle of said cylindrical casing, said set plate in the middle being positioned and arranged so as to be perpendicular to the coaxial centerline of said cylindrical casing and free to slide in said cylindrical casing along the coaxial centerline;

a first catalytic element in said cylindrical casing on one side of said set plate in the middle;

a second catalytic element in said cylindrical casing on the other side of said set plate in the middle;

a first end set plate fixed in said cylindrical casing, said first catalytic element being between said set plate in the middle and said first end set plate; and a second end set plate fixed in said cylindrical casing, said second catalytic element being between said set plate in the middle and said second end set plate, said catalytic elements being retained in longitudinal compression against said set plate in the middle by said first and second end set plates.

2. A catalytic converter having a plurality of catalytic elements, comprising a cylindrical casing;

a rigid set plate in the middle of said cylindrical casing, said set plate in the middle being positioned and arranged so as to be perpendicular to the coaxial centerline of said cylindrical casing and free to slide in said cylindrical casing along the coaxial centerline;

a first catalytic element in said cylindrical casing on one side of said set plate in the middle;

a second catalytic element in said cylindrical casing on the other side of said set plate in the middle;

a first end set plate fixed in said cylindrical casing, said first catalytic element being between said set plate in the middle and said first end set plate;

a second end set plate fixed in said cylindrical casing, said second catalytic element being between said set plate in the middle and said second end set plate, said catalytic elements being retained in longitudinal compression against said set plate in the middle by said first and second end set plates; and resilient cushion members between each of said catalytic elements and each of said set plate in the middle and said first and second end set plates and also being retained in longitudinal compression.

3. The catalytic converter of claim 1 wherein said catalytic elements are spaced apart at least five millimeters by said set plate in the middle.

4. The catalytic converter of claim 2 wherein said set plate in the middle includes two rings, each said ring having an axially extending flange enclosing said cushion member between said flange and said cylindrical casing.

* * * * *